US006482030B1

(12) United States Patent
Kuo

(10) Patent No.: US 6,482,030 B1
(45) Date of Patent: Nov. 19, 2002

(54) STACKED ELECTRONIC CARD CONNECTOR ASSEMBLY

(75) Inventor: Ming-Lun Kuo, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/025,657

(22) Filed: Dec. 18, 2001

(51) Int. Cl.[7] ..... H01R 13/62
(52) U.S. Cl. ..... 439/541.5; 439/159
(58) Field of Search ..... 439/541.5, 76.1, 439/159, 160, 64, 79, 607

(56) References Cited

U.S. PATENT DOCUMENTS 5,709,568 A * 1/1998 Pan et al. ..... 439/541.5
5,967,803 A * 10/1999 Ho ..... 439/541.5
6,062,904 A * 5/2000 Oguchi et al. ..... 439/76.1
6,071,149 A * 6/2000 Hara ..... 439/159
6,132,243 A * 10/2000 Hirata et al. ..... 439/79
6,146,193 A * 11/2000 Yu ..... 439/541.5
6,174,197 B1 * 1/2001 Hirata et al. ..... 439/541.5
6,183,273 B1 * 2/2001 Yu et al. ..... 439/541.5
6,193,547 B1 * 2/2001 Tung ..... 439/541.5

* cited by examiner

*Primary Examiner*—Gary Paumen
(74) *Attorney, Agent, or Firm*—Wei Te Chung

(57) ABSTRACT

An electrical connector assembly (6) comprises two different types of first and second electrical card connectors (1, 2) stacked with each other for receiving first and second electronic cards, respectively. The first connector includes a first insulative frame (34), a terminal module (12) received in the first frame, a first metal shell (24), and a first ejector member (25) pivotally attached to the first metal shell. The second electronic card connector includes a second insulative frame (11), a plurality of terminals (122) retained in the second frame, a second metal shell (20) and a second ejector member (21) pivotally fastened to the metal shell. An actuator member (4) is positioned adjacent either of the first and second ejector members for cooperatively ejecting the first or second electronic cards.

14 Claims, 10 Drawing Sheets

STACKED ELECTRONIC CARD CONNECTOR ASSEMBLY

BACKGROUND OF THE INVENTION

1. Field of the Invention

The present invention relates to a stacked electronic card connector assembly, and particularly to such an assembly having an ejector means for ejecting electronic cards inserted therein.

2. Description of Prior Art

Electronic card connectors are widely used for reading/accessing electronic cards, such as PCMCIA (Card Bus) cards, Smart Cards and so on. Such an electronic card can only be accessed by means of a unique card connector. The card connector is provided with an ejector means at one lateral side thereof for ejecting the electronic card inserted therein. Generally, the card connectors are individually and side-by-side mounted in computers for receiving corresponding electronic cards. Accordingly, not only the number of components in computers is increased, but also a large space is required for accommodating such individual electronic card connectors.

Hence, it is desired to provide a stacked electronic card connector assembly for alleviating the above-discussed problems.

BRIEF SUMMARY OF THE INVENTION

A main object of the present invention is to provide a stacked electronic card connector assembly having ejector means.

A second object of the present invention is to provide a stacked electronic card connector assembly consisting of two different types of electronic card connectors.

An electronic card connector assembly in accordance with the present invention comprises first and second electrical card connectors stacked with each other for receiving first and second electronic cards, respectively. The first connector, named as a smart card connector, includes a first insulative frame, a terminal module received in the first frame, a first metal shell partially covering on the first frame and a first ejector member pivotally attached to the first metal shell. The second electronic card connector, named as a card bus connector, is attached to the first electronic card connector for receiving a second electronic card. The second connector includes a second insulative frame, a plurality of terminals retained in the second frame, a second metal shell covering on the second frame and a second ejector member pivotally attached to the second metal shell. An actuator member is positioned adjacent either of the first and second ejector members for cooperatively ejecting the first or second electronic cards.

Other objects, advantages and novel features of the invention will become more apparent from the following detailed description of the present embodiment when taken in conjunction with the accompanying drawings.

DETAILED DESCRIPTION OF THE INVENTION

Reference will now made to drawing figures for more detailed description of the present invention.

Figure 1:
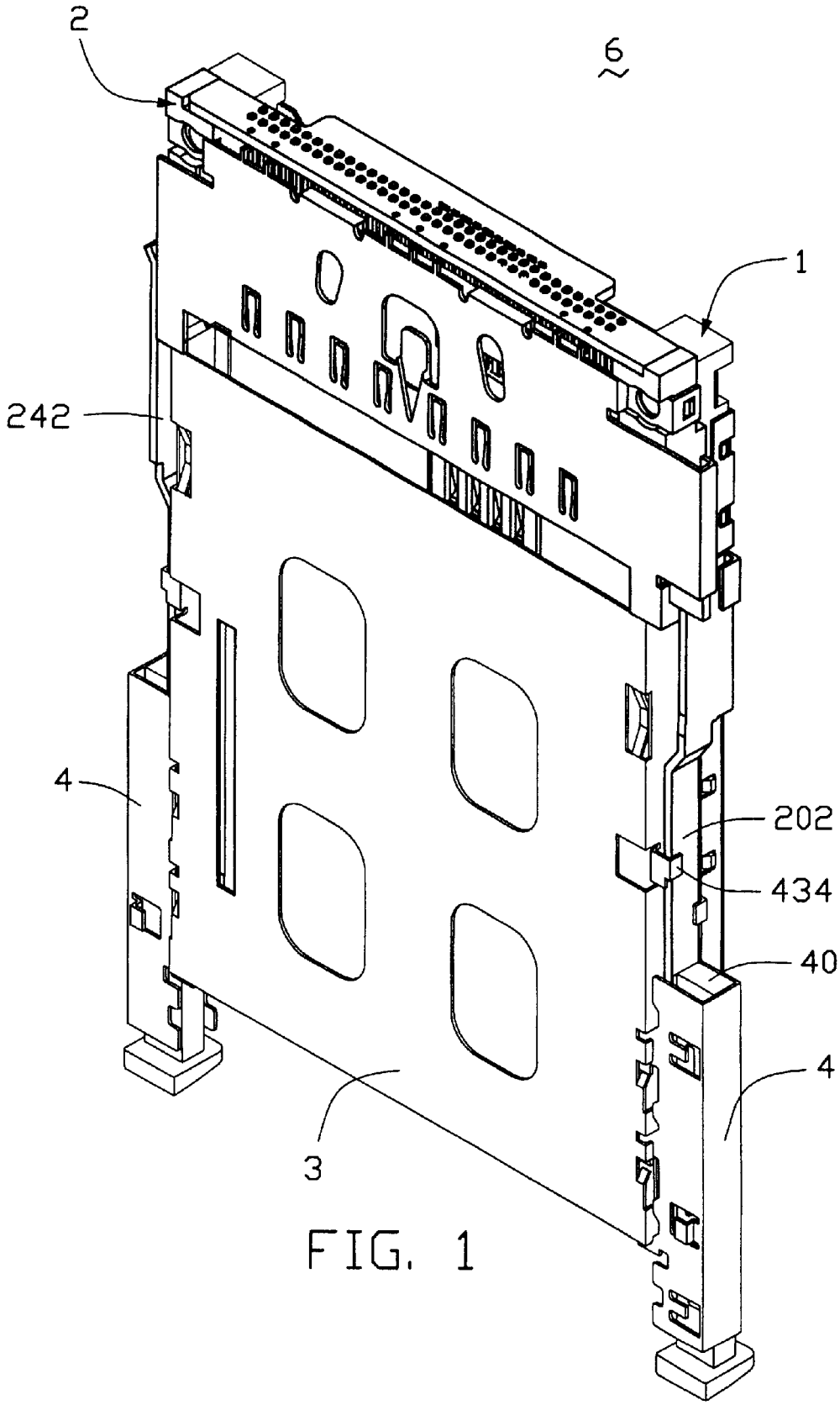
FIG. 1 is an assembled perspective view of a stacked electrical connector assembly in accordance with the present invention.

Referring to FIG. 1 first, a stacked electronic card connector assembly 6 in accordance with the present invention is shown in its assembled and perspective view. The connector assembly 6 comprises first and second electronic card connectors 1, 2 stacked with each other, an outer metal shell 3 covering the stacked connectors 1, 2 and a pair of ejector members 4 attached to the outer metal shell 3.

The stacked first and second electrical connectors 1, 2 are mainly disclosed in U.S. patent application Ser. No. 10/623,613, titled "stacked electronic card connector assembly" and filed concurrently with the present application, which is incorporated herein by reference.

Figure 2:
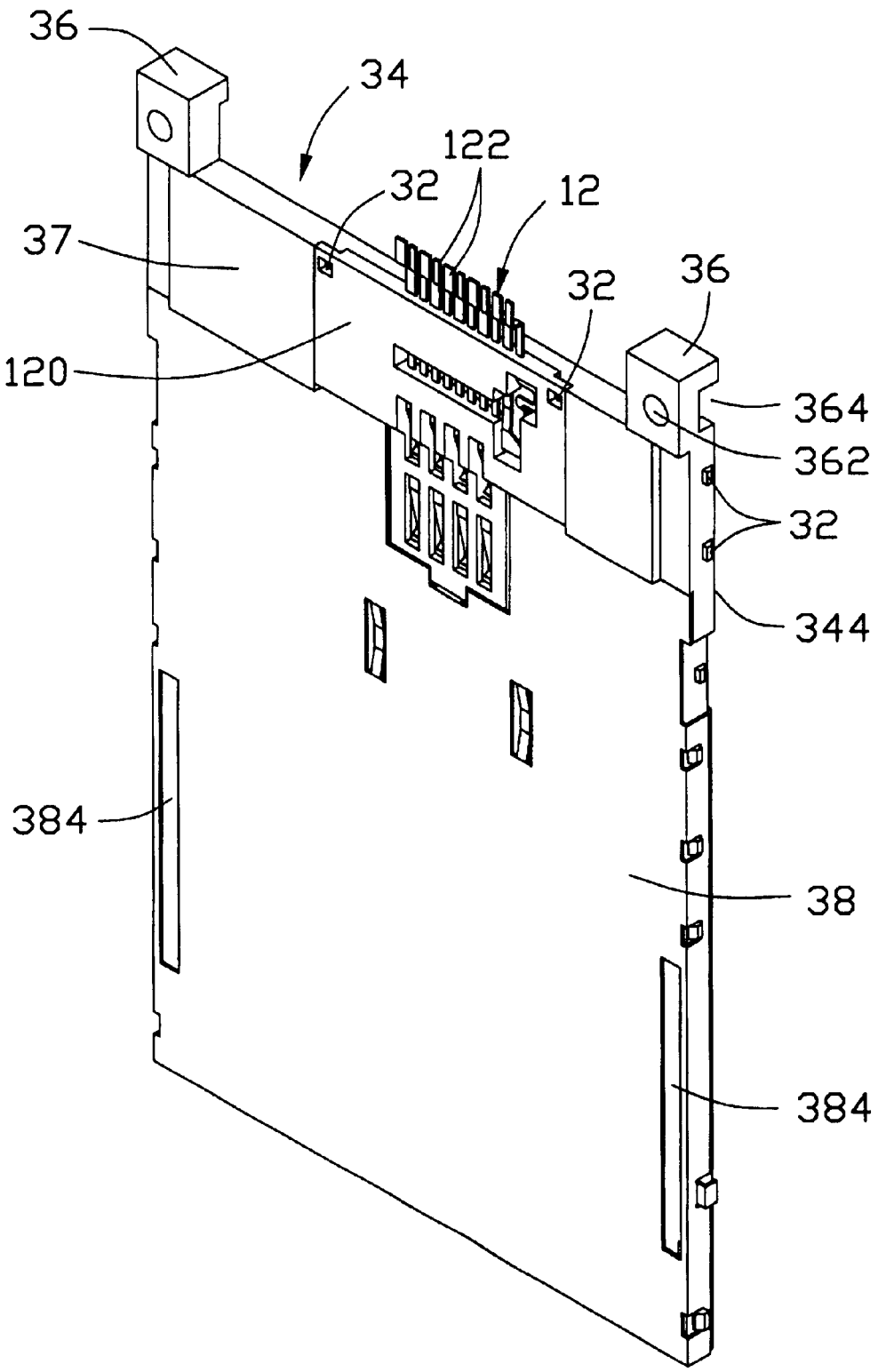
FIG. 2 is a perspective view of a first frame retaining a terminal module of a first electronic card connector of the connector assembly of FIG. 1.
Figure 3:
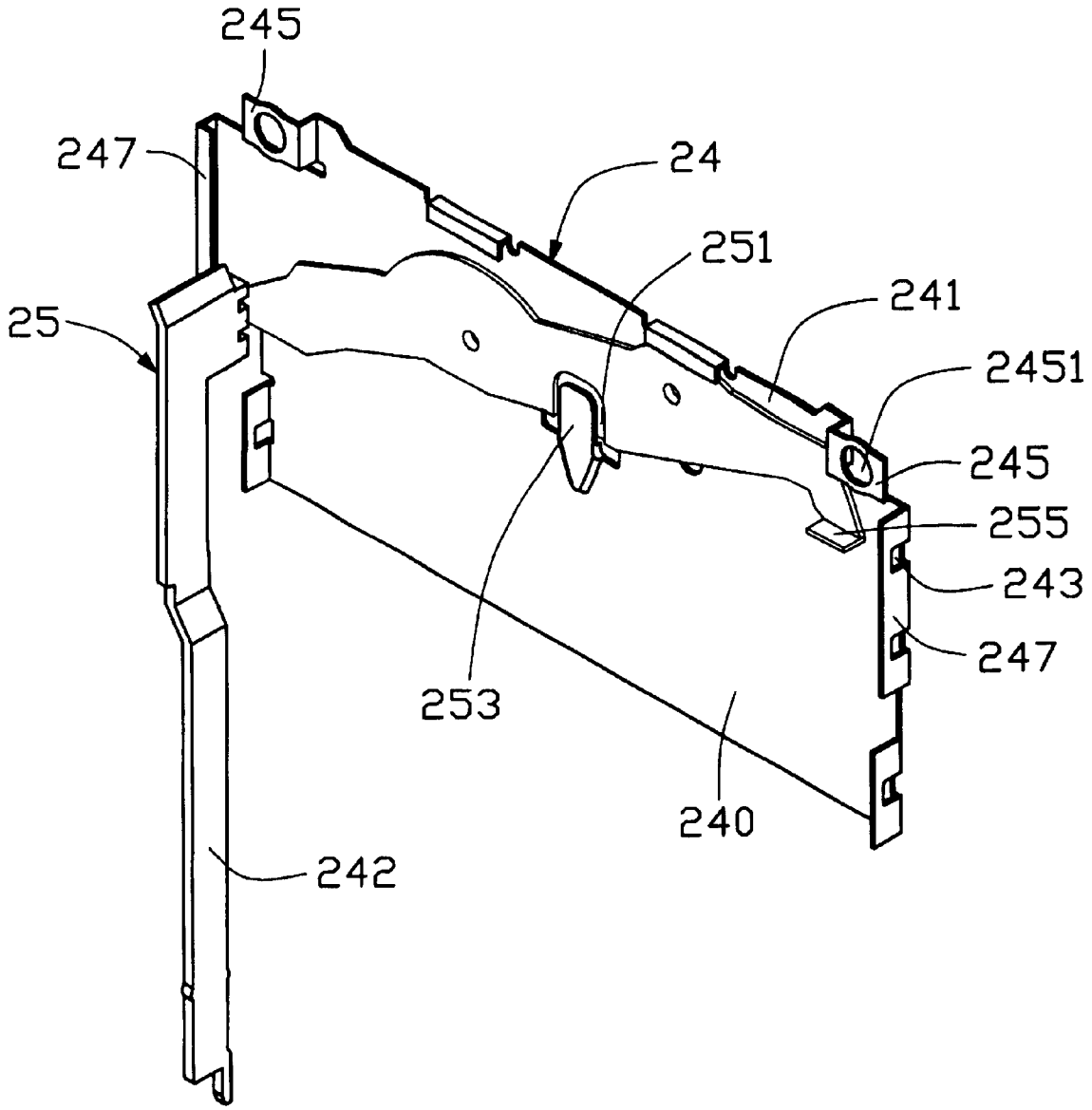
FIG. 3 is a perspective view of a first metal shell of the first electronic card connector.
Figure 4:
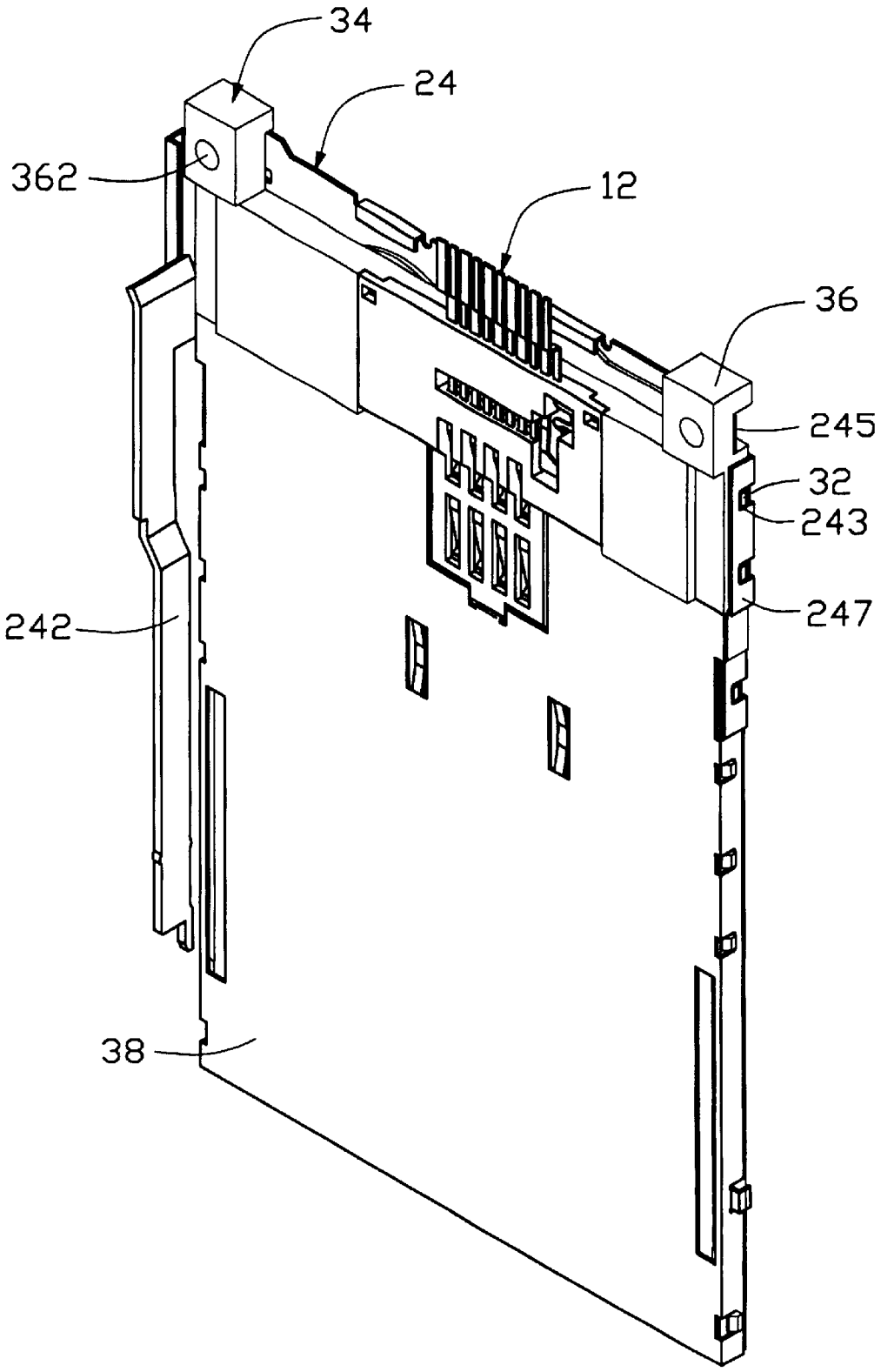
FIG. 4 is an assembled perspective view of FIGS. 2 and 3.

Further referring to FIGS. 2 to 4, the first electrical connector 1, named as a smart card connector, comprises a first frame 34, a terminal module 12 retained in the frame 34, a first metal shell 24 to be covered on the frame 34 and a first ejector member 25 pivotally attached to the first metal shell 24. The frame 34 and the terminal module 12 are detailedly described in the above-mentioned referenced application, and thus they are only summarily described hereafter. The first frame 34 forms a body portion 37 and an inner metal shell 38 covered on the body portion 37. A pair of blocks 36 are formed at an upper end of the body portion 38 and each block 36 defines a screw hole 362 and a cutout 364 in an outer face thereof. Additionally, a pair of embossments 32 on one later side of the body portion 37. The terminal module 12 has a dielectric body 120 and a plurality of conductive contacts 122 retained in the dielectric body 120 for mating with a first inserted electronic card (not shown). A pair of holes 32 are defined in opposite sides of the dielectric body 120. The inner metal shell 38 defines a pair of slits 384 in opposite sides thereof.

Referring to FIG. 3, an assembled perspective view of the first metal shell 24 and the first ejector member 25 is shown. The first metal shell 24 is covered on a rear face 344 of the frame 34 and mainly has a metal plate 240. The metal plate 240 forms a pair of resilient tabs 245 at an upper end thereof and a pair of flanges 247 at opposite sides thereof. One of the flanges 247 defines a plurality of holes 243 for fittingly engaging with corresponding embossments 32 of the frame 34. Each resilient tab 245 is inserted into a corresponding cutout 364 of the frame 34 and defines an aperture 2451 aligned with the screw hole 362 associated with the corresponding cutout 364. Additionally, the first ejector member 25 includes a lever 241 and a metal bar 242 pivotally connected with one end of the lever 241 for cooperatively ejecting the inserted electronic card, such as a smart card. The lever 241 has a pivot part 251 pivotally attached to a pivot member 253 of the metal plate 240, and an ejecting tab 255 at the other end thereof for ejecting the inserted electronic card.

Figure 5:
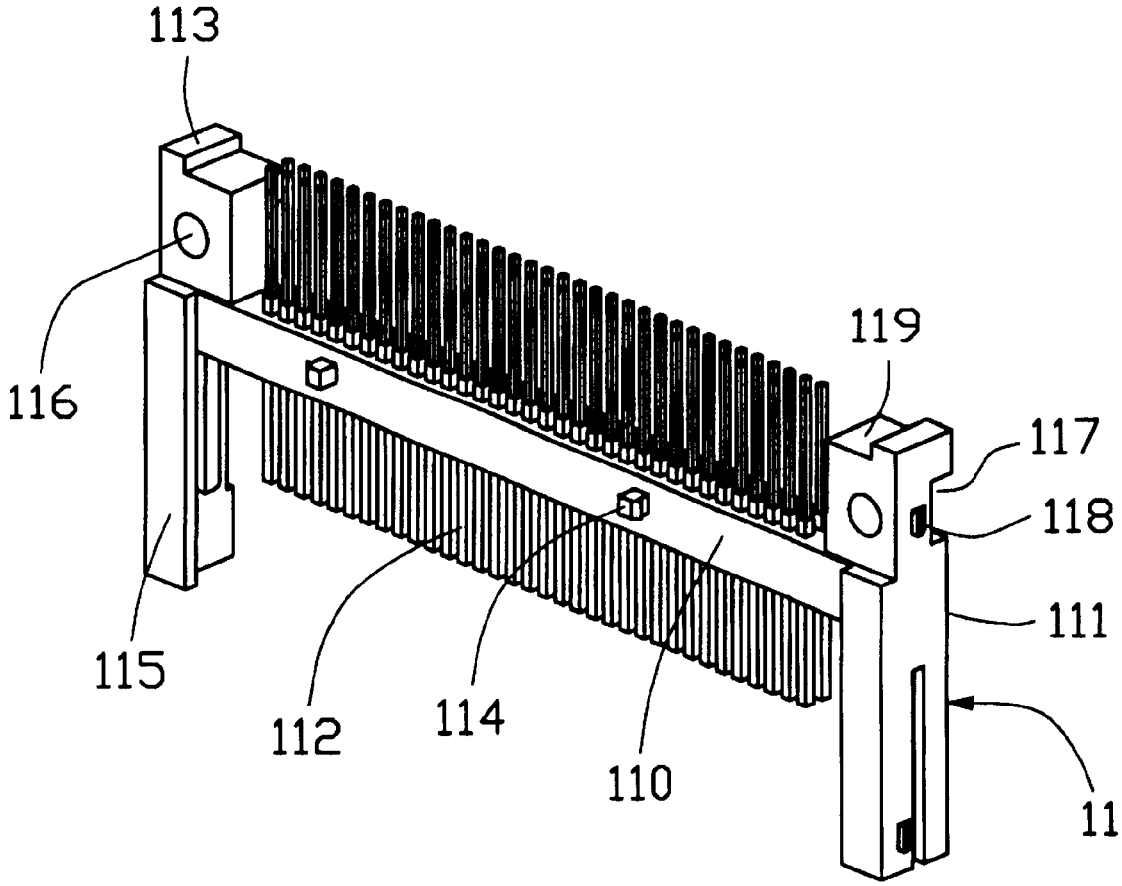
FIG. 5 is a perspective view of a second frame of a second electronic card connector of the connector assembly of FIG. 1.
Figure 6:
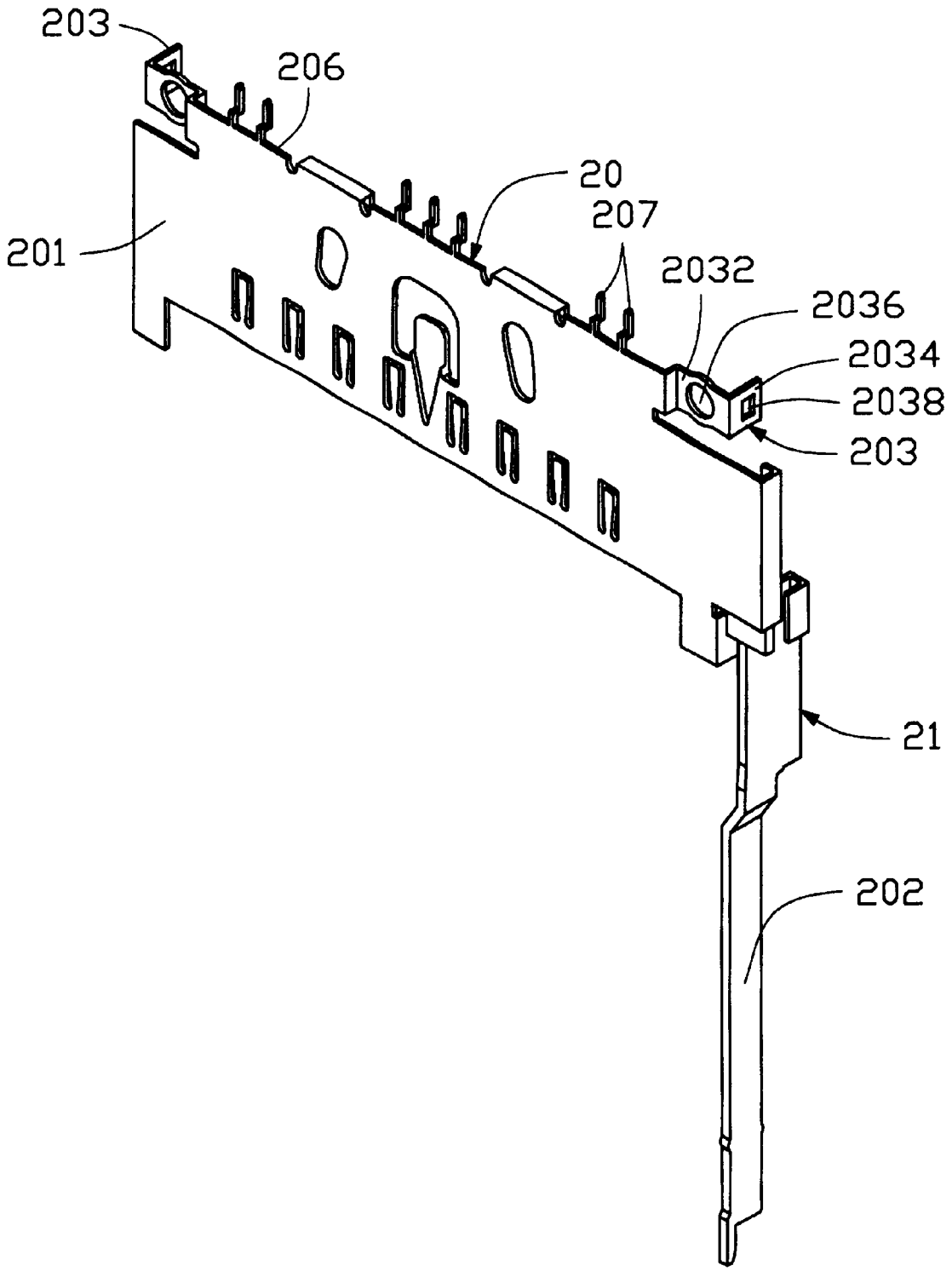
FIG. 6 is a perspective view of a second metal shell of the second electronic card connector.
Figure 7:
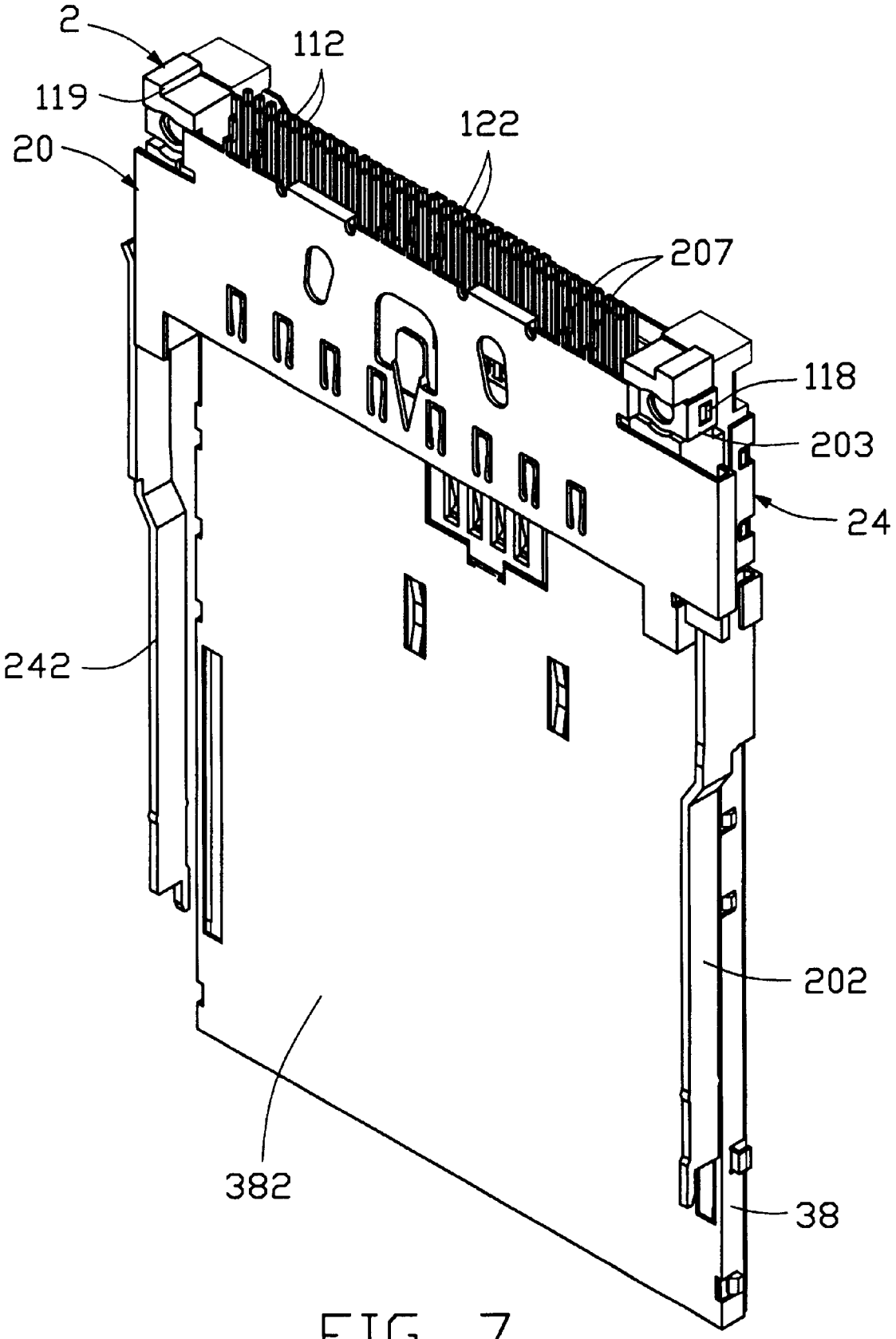
FIG. 7 is an assembled perspective view of FIGS. 4, 5 and 6.

Further referring to FIGS. 5 to 7, the second electronic card connector 2, named as a card bus connector, includes a second frame 11, a plurality of terminals 112 retained in the second frame 11 for mating with a second inserted electronic card (not shown), such as a PCMCIA card, a second metal shell 20 and a second ejector member 21 pivotally connected with the second metal shell 20. The second frame 11 is also detailed described in the above-mentioned referenced application and has an elongate body 110, a pair of second blocks 113 and a pair of elongate bars 115 respectively extending upward and downward from opposite ends of the elongate body 110. The elongate body 110 comprises a pair of protrusions 114 on a front surface thereof for inserting into corresponding holes 32 of the terminal insert 12 of the first connector 1. The second block 113 also defines a second screw hole 116 and a second cutout 117 both respectively similar to the first screw hole 362 and the first cutout 364. Additionally, the second block 113 forms a bump 118 on a lateral side thereof and defines a recess 119 in a top face thereof.

Referring to FIG. 6, the second metal shell 20 and the second ejector member 21 are respectively similar to the first metal shell 24 and the first ejector member 25 and thus, they are only summarily described below. The second metal shell 20 is covered on an outer surface 111 of the second frame 11 and forms a pair of resilient tabs 203 and several ground tails 207 projecting upward from an upper end 206 thereof. The resilient tab 203 has a first section 2032 defining a second screw hole 2036 and a second section 2034 normal to the first section 2032. An opening 2038 is defined in the second section 2034 for fittingly engaging with the bump 118 of the second frame 11. The second ejector member 21 also has a lever (not shown) and a second metal bar 202 pivotally connected with the lever for cooperatively ejecting the second electronic card.

Figure 8:
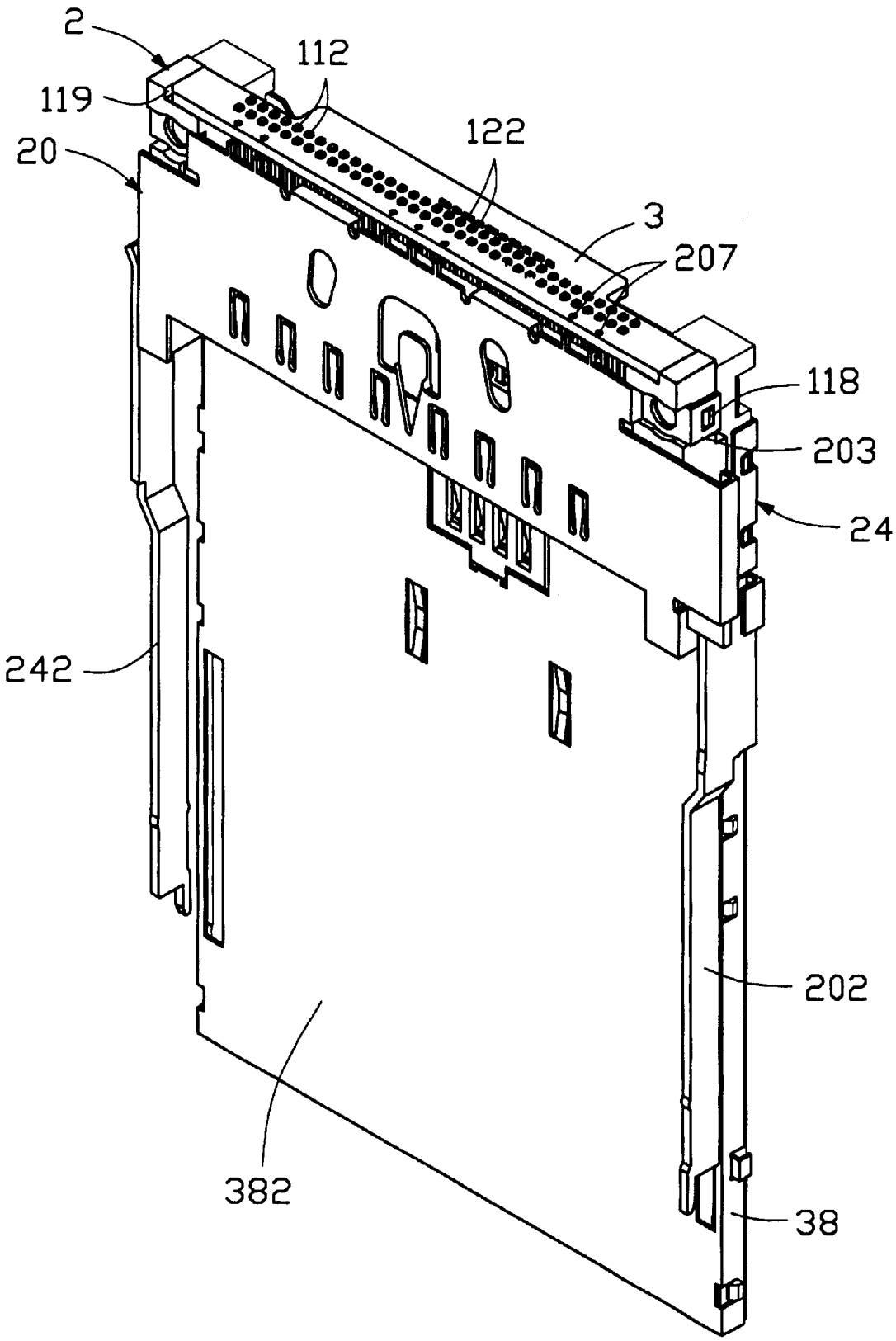
FIG. 8 is an assembled perspective view of a transition circuit board assembled with the assembly of FIG. 7.

Referring to FIG. 8, a transition circuit board 3 assembled with the stacked first and second electrical connectors 1, 2 is shown. The transition circuit board 3 is mounted in the recesses 119 of the second frame 11, and the conductive contacts 122 and terminals 112 of the first and second connectors 1, 2 and the grounding tails 207 of the second metal shell 20 are soldered to corresponding footprints (not labeled) of the transition circuit board 3.

Figure 9:
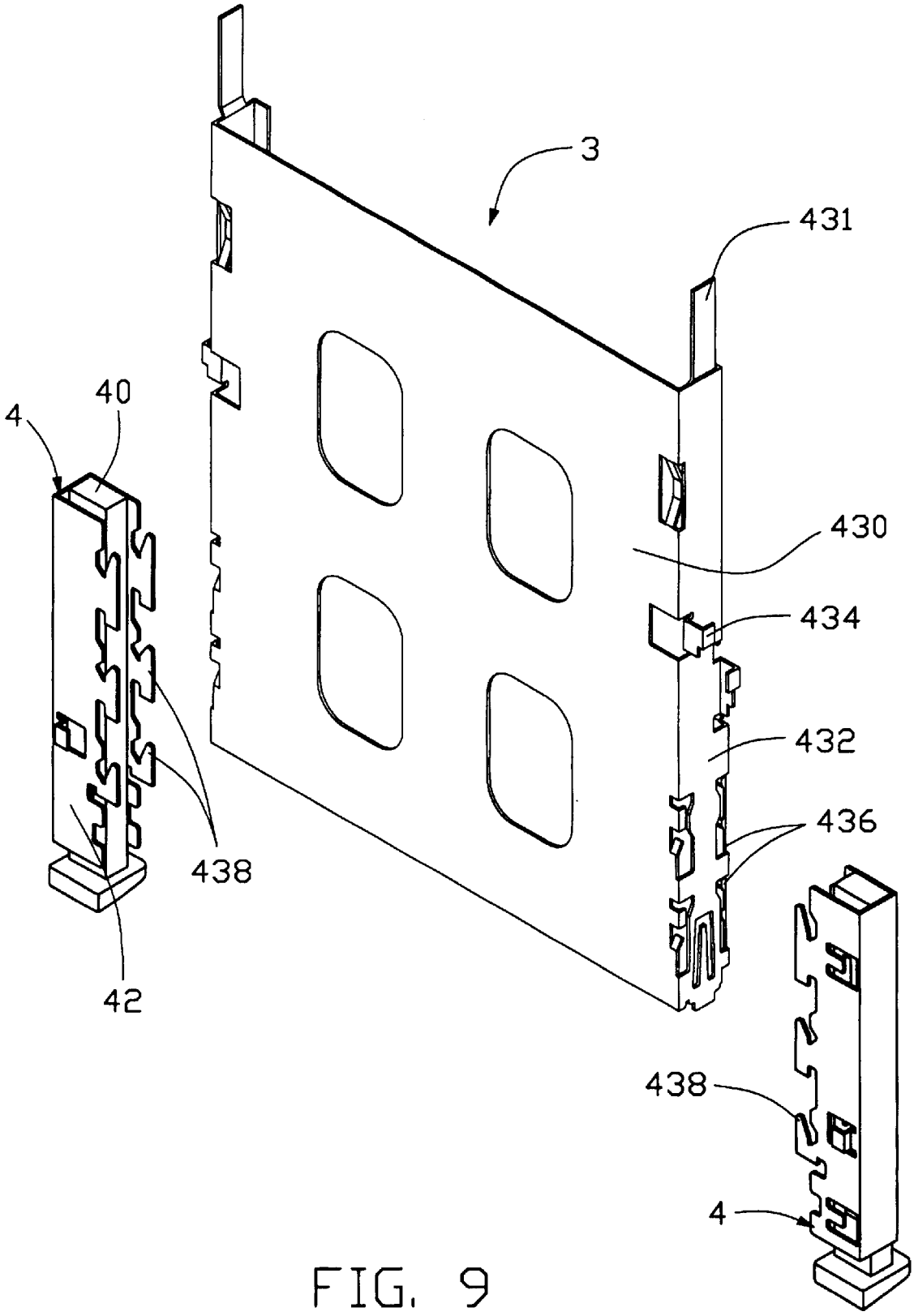
FIG. 9 is an exploded perspective view of an outer metal shell and a pair of pushing bars of the connector assembly of FIG. 1.
Figure 10:
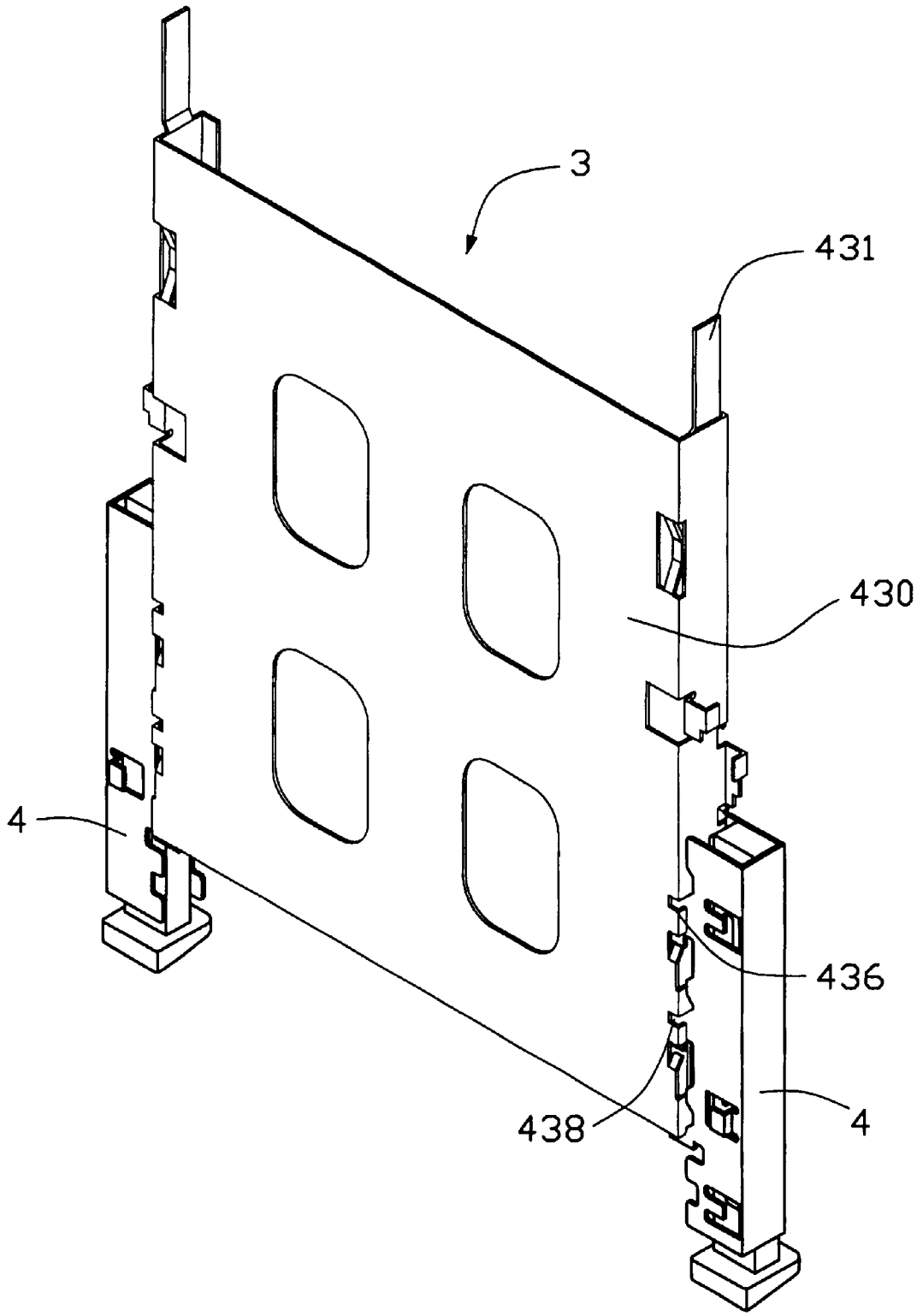
FIG. 10 is an assembled view of FIG. 9.

Referring to FIGS. 9 and 10, the outer metal shell 3 is covered on the inner metal shell 38 of the first electrical connector 1 and forms a metal sheet 430 and a pair of flanges 432 vertically extending from opposite sides of the metal sheet 430. A pair of latches 431 extend upward from the flanges 431 for latching into corresponding slits (not shown) defined in the second electrical connector 2. Each flange 432 forms a retaining tab 434 and several receiving holes 436 below the retaining tab 434. The actuator members 4 are attached to opposite sides of the metal shell 3 for ejecting the first and second electronic cards out of the connector assembly 6, cooperatively with the first and second ejector members 25, 21. The actuator member 4 forms a pushing rod 40 and a metal enclosure 42 surrounding the pushing rod 40. The metal end several latching members 438 for latching into corresponding receiving holes 436 of the outer metal shell 3.

In assembly, referring to FIGS. 1 to 9, the first and second frames 34, 11 of the first and second card connectors 1, 2 are first stacked with each other. The first and second metal shells 24, 20 respectivley assembled with the first and second ejector members 25, 21 are covered on the first and second frames 34, 11, respectively. The outer metal shell 3 connected with the actuator members 4 is next covered onto the front face 382 of the inner metal shell 38 and the retaining tabs 434 thereof are latched first and second metal bars 242, 202, respectively. Meanwhile, the actuator members 4 are respectively positioned adjacent the first and second metal bars 242, 202 for cooperatively ejecting the inserted first and second electronic cards, respectively. Thus, the whole assembly of the stacked electronic card connector assembly 6 is obtained, as is shown in FIG. 1.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector assembly comprising:

a transition circuit board;

a first type of electrical card connector for receiving a first electronic card, including a first insulative frame having opposite front and rear faces, a terminal module received in the first insulative frame and having a plurality of conductive contacts electrically connect with the transition circuit board, a first metal shell partially covering the rear face of the first frame, and a first ejector member pivotally fastened to the first metal shell, a second type of electronic card connector being attached to the first electronic card connector and receiving a second electronic card different from the first electronic card, including a second insulative frame attached to the front face of the first frame, a plurality of terminals retained in the second insulative frame and electrically connect with the transition circuit board, a second metal shell covering on the second insulative frame, and a second ejector member pivotally fastened to the second metal shell; and a respective actuator member cooperating with each of the first and second ejector members for ejecting a corresponding one of the first and the second electronic cards.

2. The electrical connector assembly as claimed in claim 1, wherein the first electronic card connector is a Smart Card connector.

3. The electrical connector assembly as claimed in claim 1, wherein the second electronic card connector is a Card Bus connector.

4. The electrical connector assembly as claimed in claim 1, wherein the terminal module having a dielectric body and a plurality of conductive contacts retained in the dielectric body.

5. The electrical connector assembly as claimed in claim 1, wherein the first electronic card connector further comprises an inner metal shell covering the first frame.

6. The electrical connector assembly as claimed in claim 5 further comprising an outer metal shell mounted on the inner metal shell.

7. The electrical connector assembly as claimed in claim 6, wherein the actuator members are fastened to opposite sides of the outer metal shell and each has a push rod and a metal enclosure surrounding the push rod.

8. The electrical connector assembly as claimed in claim 1, wherein the first ejector member comprises a lever pivotally attached to the first metal shell and a metal bar connected with one end of the lever and located at one lateral side of the first metal shell.

9. The electrical connector assembly as claimed in claim 8, wherein the first metal shell forms a flange at another lateral side thereof and the flange defines several apertures, and wherein the first frame forms several embossments on one side thereof for fittingly engaging with the apertures.

10. The electrical connector assembly as claimed in claim 7, wherein the second metal shell has a similar structure with the first metal shell.

11. The electrical connector assembly as claimed in claim 8, wherein the second ejector member has a similar structure with the first ejector member.

12. An electrical connector assembly comprising:

a first type card connector including:

a first insulative housing with a plurality of first contacts extending in a front-to-back direction;

a first metal shell covering said first housing and defining a first receiving cavity;

a first ejection mechanism assembled to the first metal shell with means moveable in said first receiving cavity for ejecting a card received therein;

a second type card connector fixedly mounted upon the first type card connector, and including:

a second insulative housing with a plurality of second contacts extending in said front-to-back direction;

a second metal shell covering said second housing and defining a second receiving cavity;

a second ejection mechanism assembled to the second metal shell with means moveable in said second receiving cavity for ejecting another card received therein;

wherein said first type card connector and said second type card connector are different from each other in both configurations and dimensions, and one of said first contact and said second contact is of a stiff pin type while the other is of a spring arm type with a vertical deflection thereof.

13. The assembly as claimed in claim 12, wherein said first contact is of the spring arm type and the second contact is of the stiff pin type.

14. The assembly as claimed in claim 12, wherein said first ejection mechanism includes a first pushing rod moveable along said front-to-back direction and located on one side of the assembly, and said second ejection mechanism includes a second pushing rod moveable along said front-to-back direction while located on the other side of the assembly.

* * * * *